United States Patent [19]

Havekost et al.

[11] Patent Number: 4,751,962

[45] Date of Patent: Jun. 21, 1988

[54] TEMPERATURE RESPONSIVE LAMINATED POROUS METAL PANEL

[75] Inventors: Scott L. Havekost; Robert T. Vivace, both of Indianapolis, Ind.

[73] Assignee: General Motors Corporation, Detroit, Mich.

[21] Appl. No.: 827,943

[22] Filed: Feb. 10, 1986

[51] Int. Cl.[4] ..... F02C 3/14; F23R 3/42

[52] U.S. Cl. ..... 165/40; 236/93 R; 60/754

[58] Field of Search ..... 60/528, 754–757; 62/383; 236/93 R; 165/40

[56] References Cited

U.S. PATENT DOCUMENTS

| | | | |
|---|---|---|---|
| 3,557,553 | 1/1971 | Schmitz | 60/754 |
| 3,584,972 | 6/1971 | Bratkovich et al. | 416/229 |
| 4,004,056 | 1/1977 | Carroll | 428/593 |
| 4,269,032 | 5/1981 | Meginnis et al. | 60/754 |
| 4,302,940 | 12/1981 | Meginnis | 60/754 |
| 4,312,186 | 1/1982 | Reider | 60/754 |
| 4,422,300 | 12/1983 | Dierberger et al. | 60/754 X |

*Primary Examiner*—Allen M. Ostrager

*Attorney, Agent, or Firm*—Saul Schwartz

[57] ABSTRACT

A laminated porous metal panel for high temperature gas turbine applications wherein the porosity is locally variable with temperature for optimum coolant flow under all conditions. Panel porosity automatically varies to maintain a relatively constant metal temperature regardless of surrounding temperatures and pressures. The panel includes an inner lamina exposed to hot gas, an outer lamina exposed to pressurized coolant, and a center lamina bonded therebetween. Passages within the panel direct coolant from inlet pores in the outer lamina to exhaust pores in the inner lamina. The center lamina is fabricated from first and second metal sheets having different coefficients of thermal expansion. Planar fields are defined on the center lamina inboard of the exhaust pores and constitute flexible diaphragams which deflect with temperature changes in the center lamina. Flow modulating pedestals are formed on the planar fields and cooperate with the inner lamina in defining flow orifices at the exhaust pores the cross sectional areas of which vary when the diaphragms deflect with temperature changes.

6 Claims, 1 Drawing Sheet

TEMPERATURE RESPONSIVE LAMINATED POROUS METAL PANEL

BACKGROUND OF THE INVENTION

1. Field of the Invention

This invention relates generally to gas turbine engines and, more particularly, to laminated porous metal panels for use in high temperature environments of such engines.

2. Description of the Prior Art

U.S. Pat. Nos. 3,584,972 to Bratkovich et al; 4,044,056 to Carroll; 4,269,032 to Meginnis et al; and 4,302,940 to Meginnis; all assigned to the assignee of this invention, describe laminated porous metal panels for gas turbine engine applications. In the described panels, a hot inner lamina and a relatively cooler outer lamina have holes or pores therein which communicate through internal passages in the panel. Pressurized cooling air to which the outer lamina is exposed migrates through the inlet pores in the outer lamina and through the internal passages to convection cool the panel. The cooling air then discharges from the panel through the exhaust pores in the inner lamina and provides a film cooling barrier between the heat source and the inner lamina. The porosity of the panel, a measure of the rate at which cooling air flows across the panel, is based on an anticipated heat source temperature to which the panel will be exposed and is fixed once the panel is manufactured. If the panel encounters temperatures above or below the anticipated temperature, either too much or too little cooling air flows across the panel.

BRIEF SUMMARY OF THE INVENTION

A laminated porous metal panel according to this invention represents an improvement over the panels described in the above identified patents in that its porosity varies with temperature to maintain optimum cooling air flow for a range of temperature conditions. The laminated porous metal panel of this invention includes a plurality of air flow modulating elements between the exhaust pores in the hot inner lamina and the inlet pores in the relatively cooler outer lamina which vary the panel's porosity to maintain optimum cooling air flow for a range of temperature conditions at the inner lamina. The laminated porous metal panel of this invention also includes a corresponding plurality of temperature responsive control elements connected to the modulating elements which control elements independently adjust the positions of the modulating elements, and therefore the local panel porosity, in accordance with local temperatures. The local temperature responsiveness of the control elements is an important feature of this invention because it maintains optimum cooling air flow even under hot-streak and cold-streak conditions. In a preferred embodiment of the invention, the modulating elements and the control elements are disposed on a porous center lamina bonded to and between the inner and outer laminae. In more detail, the modulating elements are pedestals on the center lamina disposed closely inboard of each of the exhaust pores and moveable toward and away from the exhaust pores to vary the cross sectional flow area of annular orifices defined between the pedestals and the exhaust pores. The control elements are bi-metal diaphragms on the center lamina connected to the pedestals which respond to local temperature conditions to position the pedestals such that the flow area of the annular orifices is just sufficient for adequate local cooling air flow. In the preferred embodiment of the laminated porous metal panel according to this invention, the center lamina is a composite member consisting of bonded layers of dissimilar metals which lamina is, in turn, bonded to the inner and outer laminae at a plurality of regularly spaced raised projections formed on the center lamina and/or the inner and outer laminae and the diaphragms are local planar fields of the center lamina where the raised projections are absent, the pedestals being formed on the center lamina in the planar fields for porosity controlling movement in accordance with relative thermal expansion of the dissimilar metals of the composite member.

DESCRIPTION OF THE PREFERRED EMBODIMENT

Figure 1:
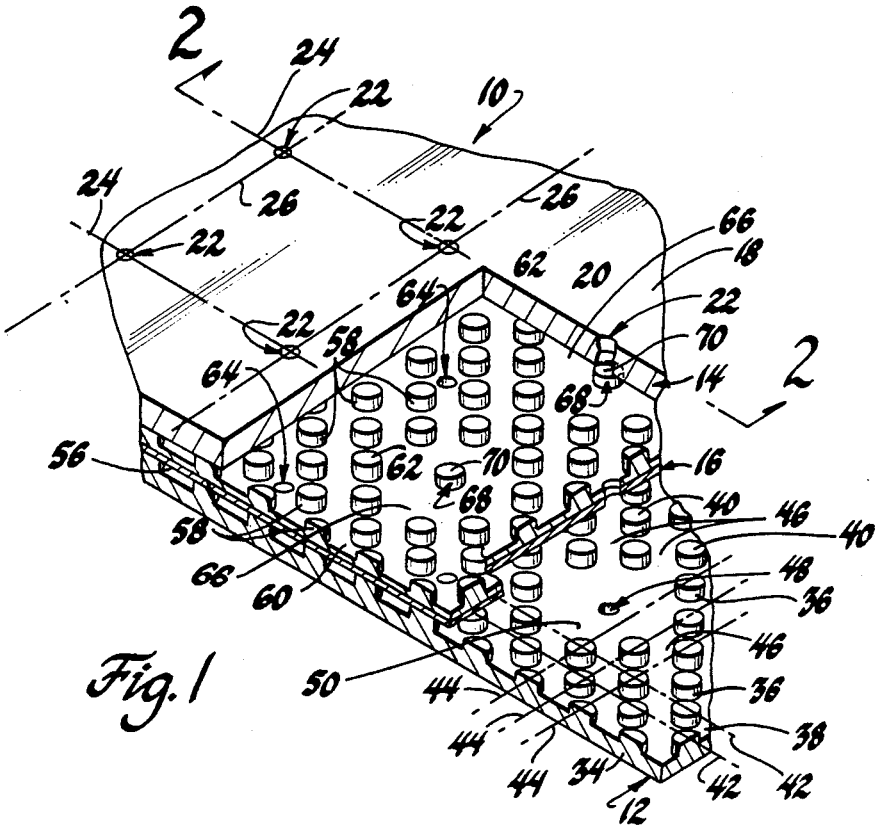
FIG. 1 is a partially broken away perspective view of a laminated porous metal panel according to this invention.
Figure 2:
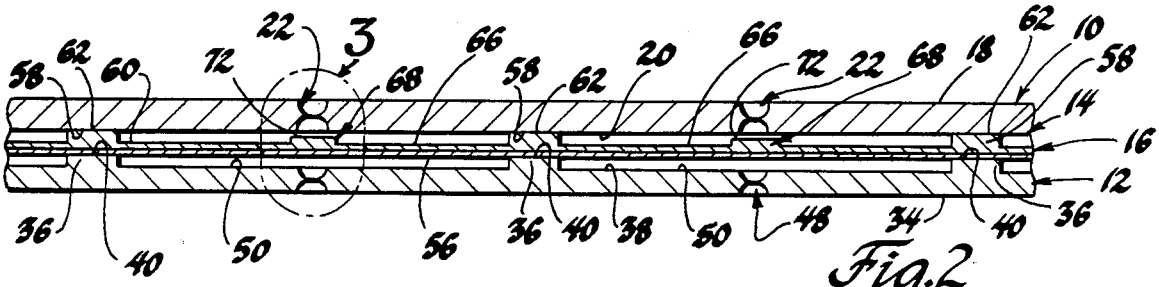
FIG. 2 is an enlarged sectional view taken generally along the plane indicated by lines 2—2 in FIG. 1.
Figure 3:
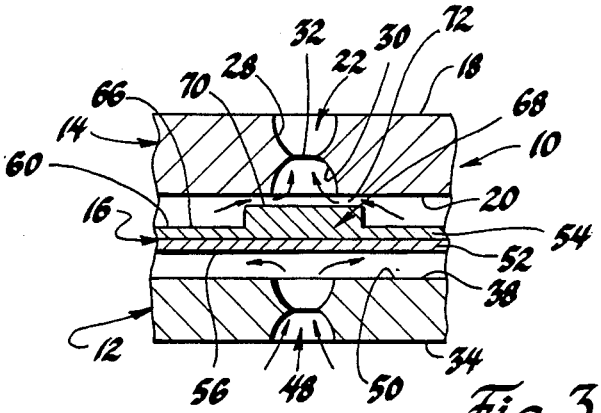
FIG. 3 is an enlarged view of the portion of FIG. 3 enclosed within the broken line circle identified by the reference character 3 in FIG. 2.

Referring now to FIGS. 1, 2 and 3, a laminated porous metal panel 10 according to this invention includes a first lamina 12, a second lamina 14, and a third lamina 16 between the first and second laminae. The laminae are illustrated in dimensionally exaggerated fashion for clarity. For example, the panel 10 may have a thickness of about 10 to 60 mils (herein used to mean thousandths of an inch). The panel 10 is particularly adapted for use in high temperature environments of gas turbine engines such as combustor, turbine and exhaust regions. In a wall of a gas turbine combustor, for example, the first lamina 12 is the outer lamina exposed to relatively cool compressed air in the plenum surrounding the combustor and the second lamina 14 is the inner lamina exposed to the high temperature combustion reaction in the combustor.

Describing each lamina individually as though it were unbonded to the others, the inner lamina 14 has a first surface 18 exposed to the hot gases and an opposite second surface 20. The first and second surfaces are plain or uninterrupted except for a plurality of exhaust pores 22 aligned in a grid-like pattern consisting of a plurality of columns 24 and a plurality of rows 26. The spacing between the columns and rows may ordinarily range between about 30 and 200 mils. The exhaust pores may be on the order of 5 to 40 mils in diameter and may be formed by chemical or electro-chemical machining techniques. For example, referring to FIG. 3, the illustrated one of the exhaust pores 22 includes a first machined depression 28 in the first surface 18 and a second machined depression 30 in the second surface 20 deep enough to intersect the first depression at a circular junction 32.

The outer lamina 12 has a plain first surface 34 exposed to the cool compressed air in the plenum and an opposite second surface which is chemically or electrochemically machined to a predetermined depth (d), FIGS. 2 and 3, to define a plurality of raised projections 36 on a relieved surface 38, each raised projection having a bonding surface 40, FIG. 1, in the plane of the second surface of the lamina. The raised projections are arrayed in parallel columns 42 and in parallel rows 44 with the projections in adjacent columns being offset by one row so that a gap 46 is defined between any two projections in a given row. A plurality of inlet pores 48 are chemically or electro-chemically or otherwise machined in the outer lamina 12 and extend between the first surface 34 and the relieved surface 38. The inlet pores 48 may be arranged in a grid-like pattern of columns and rows parallel to and having the same spacing as the columns 24 and rows 26 in which the exhaust pores 22 are arranged. A number of the raised projections 36 which would otherwise be adjacent to each of the inlet pores 48 are absent from the relieved surface 38 so that a plurality of first planar fields 50 are defined around each of the inlet pores.

The center lamina 16 is a composite member consisting of a first metal sheet 52 and a second metal sheet 54 bonded to the first metal sheet. The first metal sheet is dissimilar to the second metal sheet in that the two have different coefficients of thermal expansion. The lamina thus defined has a plain first surface 56 and an opposite second surface which is chemically or electro-chemically machined to a predetermined depth to define a plurality of raised projections 58 on a relieved surface 60, each raised projection 58 having a bonding surface 62 thereon in the plane of the second surface of the lamina. The raised projections 58 are arrayed in parallel columns and parallel rows corresponding to columns 42 and rows 44 of the raised projections 36 on the outer lamina 12 with the projections in adjacent columns being offset so that a gap is defined between any two projections in a given row. A plurality of intermediate pores 64, FIG. 1, are chemically or electro-chemically or otherwise machined in the center lamina 16 and extend between the plain first surface 56 and the relieved surface 60. The intermediate pores 64 are arranged in a regular grid-like pattern of columns and rows and are located between adjacent ones of the raised projections 58 so that a plurality of passages are defined between the projection for cooling air flow.

As seen best in FIGS. 1 and 2, the regular pattern in which the raised projections 58 on the center lamina are arrayed is interrupted at intervals by the absence of a number of raised projections whereby a plurality of second, planar fields 66 are defined. A plurality of flow modulating pedestals 68, integral with the second metal sheet 54, project perpendicular to the relieved surface 60 and are located at the centers of each of the second planar fields 66. Each pedestal 68 has a surface 70 thereon. In the illustrated embodiment, the pedestals 68 are not as high as the raised projections 58 when the planar fields 66 are flat.

The inner, outer and center laminae 14, 12 and 16 are diffusion bonded together. The positional relationship between the laminae is important. In particular, the center lamina 16 is stacked on the outer lamina 12 with flat surface 56 contacting bonding surfaces 40 and with the raised projections 58 on the center lamina registering with the raised projections 36 on the outer lamina. Additionally, each of the second planar fields 66 on the center lamina 16 registers with a corresponding one of the first planar fields 50 on the outer lamina 12. The inlet pores 48 do not register with the intermediate pores 64 so that the passages for cooling air flow therebetween is tortuous.

The inner lamina 14 is stacked on the center lamina 16 with the plain surface 20 thereof contacting the bonding surfaces 62 on the raised projections 58 on the center lamina. Positionally, the exhaust pores 22 register with or are disposed directly outboard of respective ones of the pedestals 68 on the center lamina. The exhaust pores do not register with the intermediate pores so that tortuous cooling air flow paths are defined therebetween. Diffusion bonds are achieved between the outer lamina 12 and the center lamina 16 at the bonding surfaces 40 and between the center lamina 16 and the inner lamina 14 at the bonding surfaces 62. Structurally, loads are carried across the panel 10 through the aligned raised projections 36 and 58 on the inner and center laminae. The alignment of the first and second planar fields results in the second planar fields 66 becoming bi-metal diaphragms which deflect in response to relative thermal growth between first and second metal sheets 52 and 54.

As seen best in FIGS. 1–3, cooling air entering at the inlet pores 48 flows in tortuous paths to the intermediate pores 64 and to the exhaust pores 22. Before entering the exhaust pores, however, the cooling air transits a plurality of annular orifices 72 defined between the surfaces 70 on the pedestals 68 and the surface 20 on the inner lamina 14. For a given pore and passage geometry, the porosity of the panel 10 is a function of the depth of the annular orifices 72 between the surfaces 20 and 70 which depth varies with the temperature of the bi-metal diaphragms as described below.

Describing, now, the operation of the panel 10, under ambient conditions the bi-metal flexible diaphragms supporting the pedestals 68 inboard of the exhaust pores 22 are flat and generally parallel to the surface 20 of the inner lamina 14. The porosity of the panel 10 is a minimum at this time because the pedestals 68 are at their closest positions relative to the surface 20 of the inner lamina so that the annular orifices 72 exhibit their smallest or least cross sectional flow area.

With a constant pressure difference across the panel 10, as the gas temperature adjacent the surface 18 on the inner lamina increases to a design temperature corresponding to a normal anticipated gas temperature adjacent the inner lamina, the temperature of the bi-metal flexible diaphragms increases to a corresponding design temperature. The design temperature of the flexible diaphragm is established by heat transfer from the hot gas adjacent the inner lamina to the diaphragm which occurs through the combined processes of conduction, radiation and convection and by the rate at which the cooling air cools the flexible diaphragms as it flows from the inlet pores to the exhaust pores. As the temperature of the flexible diaphragms increases from ambient to the design temperature, the relative thermal growth occurring between the first and second metal sheets 52 and 54 causes the diaphragms to deflect away from the surface 20 of the inner lamina 14, withdrawing the pedestals 68 and increasing the flow areas of the annular orifices 72. At the design temperature, the pedestals 68 are located at design positions relative to the surface 20 which positions establish a design porosity for the laminated porous metal panel 10 corresponding to the design temperature of the gas.

Gas temperature excursions above and below the design temperature often occur. In an overtemperature excursion, the heat transfer to the center lamina 16 increases thereby increasing the temperature of the bi-metal diaphragms. With increasing temperature, the bi-metal diaphragms deflect further away from the surface 20 beyond the design positions thereby moving the pedestals 68 in a porosity increasing direction away from the surface 20 so that the flow areas of the annular orifices 72 increase. Accordingly, more cooling air flows across the panel 10 to provide additional convection and film cooling. Conversely, in a gas temperature excursion in the opposite direction, heat transfer to the center lamina 16 decreases so that the temperature of the bi-metal diaphragms similarly decreases. The diaphragms then deflect in a porosity decreasing direction toward the surface 20 whereby the pedestals 68 are moved from the design positions to positions closer to the surface 20. Movement in the porosity decreasing direction decreases the flow area of the annular orifices 72 thereby decreasing the flow of cooling air across the panel 10 to a level commensurate with the lower gas temperatures.

When the pressure difference across the panel 10 changes, an additional variable is introduced because the rate of cooling air flow increases and decreases without a change of the gas temperature the inner lamina 14. For example, at constant gas temperature adjacent the inner lamina 14, increasing the pressure gradient across the panel 10 increases the rate of cooling air flow between the inlet pores 48 and the exhaust pores 22 and, hence, across the bimetal diaphragms defined by the second planar fields 66. The bimetal diaphragms are thus initially cooled below their design temperatures and deflect in the porosity decreasing direction to reduce the rate of cooling air flow. The temperature of the bimetal diaphragms then increases. When the pressure gradient stabilizes, the temperature of the bimetal diaphragms likewise stabilizes back at the design temperature but with a new, lower design cooling air flow rate and new design positions of the pedestals 68 both of which are commensurate with the new, higher pressure gradient.

As an important feature of this invention, the porosity control established by the flexible diaphragms and the pedestals 68 is local. That is, each of the flexible diaphragms responds primarily to the local heat transfer conditions around that diaphragm so that in the event of hot or cold streaks adjacent the inner lamina 14, only the cooling air flow in the neighborhood of the hot or cold streak is affected.

Modifications to the described embodiment within the scope of this invention will be readily apparent to those skilled in the art. For example, the pedestals 68 may be formed on the center lamina 16 so as to cooperate with the inlet pores 48 rather than the exhaust pores 22. Also, the planar fields 66 and the pedestals 68 may be formed so that under ambient conditions the porosity of the laminated panel 10 is zero, the porosity increasing with increasing gas temperature until the design gas temperature is achieved.

The embodiments of the invention in which an exclusive property or privilege is claimed are defined as follows:

1. A laminated porous metal panel comprising:

a first lamina having a plurality of inlet pores therein, a second lamina having a plurality of exhaust pores therein, a third lamina having a plurality of intermediate pores therein, said third lamina being disposed between said first and said second lamina and bonded to each, means on said first and said second and said third laminae defining a plurality of coolant flow passages across said panel from said inlet pores through said intermediate pores to said exhaust pores, flow modulating means on said panel disposed between said inlet and said exhaust pores and movable between a design position establishing a design coolant flow rate between said inlet and said exhaust pores and a plurality of porosity increasing and porosity decreasing positions corresponding to increased and decreased coolant flow rate relative to said design coolant flow rate, and temperature responsive control means on said panel connected to said flow modulating means and operative to position said flow modulating means in said design position at a design temperature of said second lamina and to move said flow modulating means between said plurality of porosity increasing and said porosity decreasing positions in accordance with temperature excursions of said second lamina above and below said design temperature.

2. A laminated porous metal panel comprising:

a first lamina having a plurality of inlet pores therein, a second lamina having a plurality of exhaust pores therein, a third lamina having a plurality of intermediate pores therein, said third lamina being disposed between said first and said second lamina and bonded to each, means on said first and said second and said third laminae defining a plurality of coolant flow passages across said panel from said inlet pores through said intermediate pores to said exhaust pores, a plurality of individual coolant flow modulating means on said panel disposed inboard of individual ones of one of said exhaust pores and said inlet pores, means mounting each of said individual coolant flow modulating means on said third lamina for movement between a design position establishing a design coolant flow rate through said corresponding one of said exhaust pores and said inlet pores and a plurality of porosity increasing and porosity decreasing control positions corresponding to increased and decreased coolant flow rates through said corresponding one of said exhaust pores and said inlet pores relative to said design coolant flow rate, and temperature responsive control means on said panel connected to each of said individual flow modulating means and operative to position each of said individual flow modulating means in said design position at a design temperature of said third lamina and to move each of said individual flow modulating means independently of all of the other of said individual flow modulating means between said plurality of porosity increasing and said porosity decreasing positions in accordance with temperature excursions of a localized area of said third lamina adjacent said individual flow modulating means above and below said design temperature.

3. The laminated porous metal panel recited in claim 2 wherein:

each of said individual coolant flow modulating means is a raised pedestal on said third lamina disposed inboard of said corresponding one of said exhaust pores and said inlet pores.

4. The laminated porous metal panel recited in claim 3 wherein:

said means mounting each of said individual flow modulating means on said third lamina is a flexible diaphragm portion of said third lamina to which a corresponding one of said raised pedestals is rigidly attached.

5. The laminated porous metal panel recited in claim 4 wherein:

said third lamina is a bi-metal member fabricated from a pair of metal sheets having unequal coefficients of thermal expansion so that each of said flexible diaphragm portions of said third lamina constitutes said temperature responsive control means connected to each of said individual flow modulating means.

6. A laminated porous metal panel comprising:

a first lamina having a plurality of inlet pores therein, means on said first lamina defining a plurality of raised projections arrayed in a regular pattern on one surface of said first lamina, a second lamina having a plurality of exhaust pores therein, a bi-metal third lamina fabricated from a first metal sheet and a second metal sheet having different coefficients of thermal expansion, means on said third lamina defining a plurality of intermediate pores therein, means on said third lamina defining a plurality of raised projections arrayed in a regular pattern on one surface of said third lamina, said third lamina being disposed between and diffusion bonded to said first and said second laminae with said first lamina raised projections engaging said third lamina and said third lamina raised projections engaging said second lamina so that a plurality of tortuous coolant flow paths are defined from said inlet pores to said intermediate pores and from said intermediate pores to said exhaust pores, said first and said third laminae raised projections being positionally aligned to provide structural load paths across said panel, means on said first lamina defining a first planar field in said regular array of raised projections thereon, means on said third lamina defining a second planar field in said regular array of raised projections thereon located in positional alignment with one of said exhaust pores and in positional alignment with said first planar field so that said second planar field constitutes a flexible bi-metal diaphragm located inboard of said one exhaust pore, said bi-metal flexible diaphragm deflecting through a plurality of control positions relative to said second lamina in response to local temperature changes in said third lamina at said flexible diaphragm, and means integral with said third lamina defining a flow modulating pedestal on said one surface of said third lamina in said second planar field adjacent said one exhaust pore so that said pedestal cooperates with said second lamina in defining an annular orifice between said intermediate pores and said one exhaust pore, said pedestal being moved by said bi-metal flexible diaphragm relative to said second lamina in porosity increasing and porosity decreasing directions corresponding to deflection of said diaphragm through said control positions whereby the flow area of said annular orifice varies with changes in temperature of said third lamina at said second planar field.

* * * * *